US007370956B2

(12) United States Patent
Figov

(10) Patent No.: US 7,370,956 B2
(45) **Date of Patent: *May 13, 2008**

(54) METHOD AND MEDIA FOR PRINTING AQUEOUS INK JET INKS ON PLASTIC SURFACES

(75) Inventor: Murray Figov, Ra'anana (IL)

(73) Assignee: Kodak IL Ltd., Petach Tikva (IL)

( * ) Notice: Subject to any disclaimer, the term of this patent is extended or adjusted under 35 U.S.C. 154(b) by 143 days.

This patent is subject to a terminal disclaimer.

(21) Appl. No.: 10/552,018

(22) PCT Filed: Dec. 30, 2003

(86) PCT No.: PCT/IL03/01113

§ 371 (c)(1),
(2), (4) Date: Oct. 3, 2005

(87) PCT Pub. No.: WO2004/087435

PCT Pub. Date: Oct. 14, 2004

(65) Prior Publication Data

US 2006/0203062 A1 Sep. 14, 2006

Related U.S. Application Data

(60) Provisional application No. 60/458,968, filed on Apr. 1, 2003.

(51) Int. Cl.
*B41J 2/01* (2006.01)

(52) U.S. Cl. ..... 347/102; 347/100; 347/101; 347/105

(58) Field of Classification Search ..... 347/100, 347/101, 102, 105
See application file for complete search history.

(56) References Cited

U.S. PATENT DOCUMENTS

| | | | | |
|---|---|---|---|---|
| 3,889,270 | A | 6/1975 | Hoffmann et al. | |
| 4,269,891 | A | 5/1981 | Minagawa | |
| 4,474,850 | A | 10/1984 | Burwasser | |
| 4,592,951 | A | 6/1986 | Viola | |
| 4,649,064 | A | 3/1987 | Jones | |
| 4,966,804 | A * | 10/1990 | Hasegawa et al. | 428/203 |
| 5,537,137 | A | 7/1996 | Held et al. | |
| 5,594,044 | A * | 1/1997 | Yang | 523/160 |
| 5,747,166 | A * | 5/1998 | Schwarte et al. | 428/423.1 |
| 6,095,050 | A | 8/2000 | Figov | |
| 6,135,654 | A | 10/2000 | Jennel | |
| 6,361,847 | B1 | 3/2002 | Magnusson et al. | |
| 6,428,143 | B2 * | 8/2002 | Irihara et al. | 347/43 |
| 6,443,568 | B1 * | 9/2002 | Askeland et al. | 347/98 |
| 6,655,798 | B2 * | 12/2003 | Temple | 347/101 |
| 7,001,016 | B2 * | 2/2006 | Baxter et al. | 347/101 |
| 7,219,989 | B2 * | 5/2007 | Uerz et al. | 347/101 |
| 2001/0036552 | A1 | 11/2001 | Otani et al. | |
| 2005/0195260 | A1 * | 9/2005 | Figov et al. | 347/102 |
| 2006/0125902 | A1 * | 6/2006 | Figov | 347/105 |

FOREIGN PATENT DOCUMENTS

| | | | |
|---|---|---|---|
| EP | 1 251 012 | A | 10/2002 |
| JP | 2002-187340 | A | 7/2002 |
| WO | WO 97/270053 | A1 | 7/1997 |
| WO | WO 99/21724 | A1 | 5/1999 |

* cited by examiner

*Primary Examiner*—Stephen Meier
*Assistant Examiner*—Mark J Stevenosky, Jr.
(74) *Attorney, Agent, or Firm*—Nelson Adrian Blish

(57) ABSTRACT

Single coatings onto non-absorbent substrates on which aqueous ink jet inks are jetted with subsequent application of heat, without the use of reactive species in the ink and in the media used as a substrate coating. The heating rapidly drives the water of the ink into the coating, with the rest of the water from the ink being lost by evaporation. The material is then subject to immediate application of a sealing lacquer, which is preferably water-based and which may be dried and possibly cross-linked by heat to give a very resistant surface.

16 Claims, No Drawings

METHOD AND MEDIA FOR PRINTING AQUEOUS INK JET INKS ON PLASTIC SURFACES

CROSS-REFERENCE TO RELATED PATENT APPLICATIONS

This patent application claims priority from and is related to U.S. Provisional Patent Application Ser. No. 60/458,968, filed 1 Apr., 2003, this U.S. Provisional Patent Application incorporated by reference in its entirety herein.

FIELD OF INVENTION

The present invention relates to the production of robust plastic printed products using aqueous inkjet inks for the imaging process.

BACKGROUND FOR THE INVENTION

Plastic objects now play a major part in modern life. Such objects are marked on their surface for information and decoration. Often the plastic is handled or subject to forces of abrasion or other types of wear, which could adversely affect any surface markings. Such damage could reduce the effectiveness of any such markings.

Ink jet is a modern method of marking, which has had a large degree of success in the market for a variety of reasons. It is a non-impact printing process, whereby ink is squirted through very fine nozzles and the resultant ink droplets form an image directly on a substrate. One advantage of the process is that the equipment can be made and sold relatively inexpensively and for this reason it has been adapted for sale in the home as the prime method of printing from PC's (Personal Computers). Another advantage is that because it is a non-impact process, printing can be done on fragile surfaces such as those of eggs. As the process does not work through a master, it can be used to print variable information, where each print is different from the previous one. Working through a master means that once the master is imaged, the image is fixed for as many impressions as required. After making the required number of impressions, the master is discarded and a new one made for the next job.

There are two main types of ink jet process. In one process, usually termed continuous ink-jet printing (CIJ), a stream of ink drops are electrically charged and then are deflected by an electric field, either directly or indirectly, onto the substrate. In the second process, usually called Drop on Demand (DOD) ink-jet printing, the ink supply is regulated by an actuator such as a piezoelectric actuator. The pressure produced during the actuation forces a droplet through a nozzle onto the substrate. CIJ inks need to have some electrical conductivity, but inks for DOD ink-jet printing do not need to be conductive.

In all of the ink jet processes, in order to form suitable droplets, the ink must have a relatively low viscosity during the actual jetting process. This is generally in the region of 1 to 30 centipoise. This can be achieved by using a low viscosity carrier fluid, which may be water, or volatile organic liquid, or a relatively non-volatile organic liquid. Alternatively, the ink can be heated up to lower its viscosity during jetting. For many reasons, water has been found to be a suitable carrier liquid. It is inexpensive, readily available, environmentally harmless and has a high surface tension, which enables additives needed for the inkjet process to be used, as it is easier to find useful additives to reduce surface tension than to increase it.

Ink jet writing on plastic presents specific problems that inventors have tried to solve. One such approach is to use inks other than aqueous based, which can be made to dry and bond to plastic. WO 97/27053 by Jennel et al describes the use of inkjet to digitally write on packaging material. The printing can be done directly onto a pre-formed bottle such as one made from PET (polyester), or onto a carton blank or a web of packaging material. The invention is claimed to provide an advanced level of automation with minimum operator intervention. In order to achieve good adhesion to materials such as PET, ultra-violet (UV) sensitive inks are used and after jetting they are cured by UV radiation. The ink jet head is DOD and described as one supplied by the company Spectra. This is the most widely accepted way of using UV curing inkjet inks, as the alternative method, CIJ, generally uses water based inks and the inks must contain electrically conductive material. UV sensitive inks are generally based on organic acrylate mixtures that do not contain electrically conductive ingredients and are therefore less easily adapted for use in CIJ.

UV sensitive inkjet inks are more expensive than water-based inks and will remain so because, by definition, water-based inks contain a large quantity of water, which is relatively inexpensive. Because with UV inkjet inks all of the jetted material remains on the substrate surface (where the substrate is impermeable) inks are deposited in the form of tiny hemispherical structures. Process color work, where three or four separate inks are applied over the same area, can thus have a Braille-like feeling. Such an effect limits print quality.

The use of water-based inks on plastics would be advantageous for several reasons. As has been mentioned above, they have cost advantages; they can be used in both DOD and CIJ inkjet systems and they do not pile-up because the major part of the inkjet drop is water, which disappears either by absorption, if the substrate is pervious, or by evaporation, or both. However, there are a number of problems with using water-based inkjet inks on plastics. They have wetting problems with relatively low energy plastic surfaces (for instance that of PET) as well as slow drying, which for non-absorbent plastic surfaces has to occur only by evaporation. Also, they have low wet smear resistance—i.e. after they have dried, they can be easily smeared with a wet finger. These problems have been appreciated for some years and for instance U.S. Pat. No. 3,889,270 seeks to address this problem by using for instance polyvinyl alcohol as a coating for the substrate and including for instance hydrophilic silica gel. U.S. Pat. No. 4,269,891 uses for instance polyvinyl alcohol and pigments such as titanium dioxide for suitable substrate coatings. U.S. Pat. No. 4,474,850 uses for instance salts of high molecular weight carboxylic acids and locks the aqueous dye based inks into the surface by ionic interaction. U.S. Pat. No. 4,474,850 is concerned with the production of transparencies. U.S. Pat. No. 4,592,951 expresses the need to cross-link the polyvinyl alcohol because uncross-linked layers are generally too tacky. Jones, in U.S. Pat. No. 4,649,064 employs hydrophilic film, partially cross-linked, onto which a cross-linkable ink jet ink is jetted. The ink drying process is at room temperature. In general, in order to avoid the need for customers to have special drying units, drying is expected to occur without any additional prompting with energy such as heat and thus it is at room temperature. The ink is then cross-linked with an agent within the substrate coating. WO 99/21724 by Wang et als. addresses the problem of ink smearing. The patent application describes the use of two layers—an inner non-cross-linked hydrophilic coating and an outer cross-linked hydrophilic coating. In one embodiment, an inkjet image is applied before curing to avoid wet smear. Similarly, US 2001/0036552 by Otani et al. describes coating a substrate with two layers for water-based pigment inks to give better colors and image fastness.

U.S. Pat. No. 5,537,137 addresses the problems of aqueous inkjet printing on plastics by introducing a reactive material into the substrate coating and heating after depositing a reactive inkjet ink onto the coated substrate. The reaction fixes the ink into the coating by the reaction of the ink with the coating and also cross-links the coating itself to increase the coating durability. The disadvantages of this approach are that the presence of a reactive system, which cures the background areas, limits shelf life of any such coated product before imaging, as the cross-linking reactions that occurs rapidly at high temperatures also proceed slowly at room temperature. Also, inks used are limited to those containing reactive species either as a dye or pigment dispersion or as a polymeric material which serves as the pigment dispersant. If the energy used for fixing the ink is ultraviolet light, then the media must be protected from such light during handling. This may necessitate yellow light where the printing process occurs. The resultant prints of such a process will show variable gloss on the surface, reflecting the affect of the variations in absorption of water, dependent on the amount of ink deposited in the variable areas of the printed material. An alternative approach for achieving smear-proof images is to overcoat the ink jet image. U.S. Pat. No. 6,095,050 describes the use of organic lacquers to fix aqueous ink jet inks into uncoated substrates where the ink jet ink is still wet during the overcoating process. This method works with paper where ink absorption into the substrate enables smudging of wet on wet to be avoided.

Much of the work for aqueous ink jet printing on plastic has been addressed to achieving smear-proof properties for the purposes of handling, for applications such as the imaging of overhead transparencies. The present invention addresses more stringent requirements for handling, where the printed object may be subject to handling and solvents, which would damage ink jet images which were merely smear proof. The method and materials below described for working the present invention provide the means of producing information or decoration onto plastics using aqueous ink jet inks, resulting products being of excellent image quality as well as being smear proof and abrasion resistant and generally having a high resistance to physical and chemical damage, appropriate to the present applications. Applications for such methods and materials include cards used for ID's or for smart card applications, where the product must undergo handling and the unprinted material should benefit from a long shelf life. A further application is in the production of printing on bottles, whereby white substrate coating onto plastics such as PET (polyester) can be used to provide areas on which aqueous ink jet inks can be jetted followed by a protective overcoat, as well as providing the contrasting background for the transparent ink jet inks.

SUMMARY OF INVENTION

The present invention describes single coatings onto non-absorbent substrates on which aqueous ink jet inks are jetted with subsequent application of heat, without the use of reactive species in the ink and in the media used as a substrate coating. The heating rapidly drives the water of the ink into the coating, with the rest of the water from the ink being lost by evaporation. The image can thus be deemed to be dried. It has been found that even though rubbing with water may cause smearing, the media is sufficiently smudge proof to permit an immediate application of a sealing lacquer, which is preferably water-based and which may be dried and possibly cross-linked by heat to give a very resistant surface. This surface may be made glossy or matt as required. Alternatively, the image can be made as a lateral inversion of the required picture on a transparent substrate and then laminated to a white substrate coated with a PSA (pressure sensitive adhesive); or by printing on a white substrate or substrate coating and laminating with a transparent film.

In one aspect of the present invention, substrate coatings are described that are primarily designed for use in automated packaging. Such coatings are single layers and are hydrophilic. The layer itself may have very poor water resistance and may be removable with a damp rag. The lacquer overcoat produces an even coating on both the printed and unprinted areas, which may be either glossy or matt and which then makes the resulting plastic water and smear resistant, solvent resistant and scratch resistant. In order to print process colors onto a plastic base, either the substrate itself may be opaque white, or the substrate coating may be colored with a white pigment such as titanium dioxide. The process colors of ink jet inks have a transparency, which gives an appearance similar to printing inks onto white paper.

DETAILED DESCRIPTION OF THE INVENTION

For the purposes of this invention, the layer coated directly onto the substrate and onto which the ink jet inks are jetted will be referred to as the under-coating and the mixture from which it is deposited will be referred to as the under-coating solution, even though this solution may contain dispersed particles or emulsions. In a preferred embodiment, the application as designed for automation does not require the initial hydrophilic under-coating to be handled and therefore it may be of a fragile nature. As this is not the case with inkjet substrate under-coats as designed for non-automated systems, there is latitude in formulating such under-coats, which in the case of the present invention is wider than usual. Generally, substrate coatings are subject to handling—whether during manufacturing, packaging of the coatings or in the actual imaging process. For instance, they may require resistance to absorption of moisture from fingers and this would therefore restrict the content of hydrophilic constituents in the coating. They should not be physically weak and this limits the presence of excess pigment or filler to give good layer opacity or fast ink absorption into the coating. In the present application such coatings, whilst having characteristics of a solid film, may have poor adhesion to the substrate and poor water resistance and may be easily damaged if the surface contacts another surface or is handled in any way, until after imaging and lacquering, when excellent physical and chemical adhesion can be achieved. The coatings may be applied to a wide range of substrates but are particularly suitable for plastics such as polyester (PET) and polyvinyl chloride (PVC). The coating may be pigmented or transparent, depending on the application. A substrate with a white pigment, either incorporated therein or incorporated in the substrate under-coating, has wide application as it provides an essential background for transparent process inks. In the case of a coating, it can be applied to a designated area of the substrate and the inkjet inking can be used in just this area. This is particularly useful for bottles of drink where the color of the drink can be seen through the transparent parts of the bottle and the bottle can still have an attractive aqueous inkjet image affixed to a white area provided by the substrate under-coating, so that the color fidelity can be maintained.

It is preferable but not essential to deposit the substrate under-coating from aqueous solution.

It is also preferable, depending on the application, that the substrate under-coating materials are chosen from only those approved for food items, making their use in the food and drink industry applicable.

The method of application for use on an automated production line is as follows: apply the solution of substrate under-coating to the plastic surface; air dry to evaporate the water or solvent; apply the aqueous inkjet inks in the form of the required image; treat with heat or another form of energy to sufficiently dry the inkjet image into the substrate; then overcoat with lacquer and dry the lacquer—either to cure it, if it is cross-linkable or to drive off the water, if it is an emulsion. The overcoat then forms a protective insoluble film over both the background and the image. The entire surface of the printed substrate may now be scratch proof and proof against damage from solvents, oils and water. This method will be referred to below as the "automated" method.

In the less automated form, the substrate under-coating and initial drying may be done as a manufacturing process for supplying the coated substrate to a customer. The customer will then image the coated substrate with the aqueous inkjet inks and either reverse laminate or coat with a lacquer—preferably aqueous—to produce the finished item. This method will be referred to below as the less automated method.

Both above described methods can be applied not only to bottles and other packaging items, but also to other ink jet applications such as printing on credit cards, smart cards etc.

It is part of the invention that the color quality of the inkjet image is retained or achieved after the applied energy finishing stage has been completed to finalize the cross-linking process. Aqueous ink jet inks may be based on dye colorants or pigments and may contain technologies to enhance drying and wet strength. Thus, although with some aqueous ink formulations it may be possible to insolubilize them on uncoated plastic substrate, because of surface energy considerations, image quality may be lost completely as the inks often reticulate on plastic surfaces. Thus the under-coatings on the plastic substrate are essential for good ink jet printing.

Suitable formulations for applying to the substrate may be water-based mixtures of polyvinyl alcohol and polyacrylic acid, together with a water-based emulsion containing a hydrophobic polymer in the internal phase and stabilized at a pH of 7 or less. Examples of suitable hydrophobic water-based emulsions are acrylic type materials such as Flexobond 325 (a vinyl-acrylic copolymer—pH of 4 to 5), Walpol 40-136 a vinyl-acrylic copolymer—pH 5.0, and Flexobond 381 (a vinyl acrylic pH 4-6).

In all of the above applications, the mixture can also contain titanium dioxide or a mixture of white or opaqueing pigments dispersed therein, and fillers such as silicas and clays as are well known in the art.

Mixtures of use in this invention, when deposited on a plastic substrate, can be dried with warm air and give solid films. Deposition may be by spraying or by any other suitable means of coating.

Suitable formulations may also be organic solvent-based mixtures of an analogous composition to the water-based materials. Hydrophilic cellulose derivatives such as hydroxypropyl cellulose, which is soluble in both water and organic solvent and plays a role similar to the polyvinyl alcohol in the water-based compositions, may be deposited from solvents such as alcohol/ethyl acetate mixtures. The formulation may still contain polyacrylic acid, which may be dissolved in an alcohol such as ethanol. The third polymeric material—a hydrophobic resin may be an acrylic thermoplastic such as for instance Setalux 17-1354. Such mixtures may be deposited and treated in a similar fashion to the water-based coatings and can be used for the automated or less automated applications. They are more applicable to the less automated applications where the plastic coating is produced in an industrial coating environment, where solvent is recovered or incinerated as integral to the coating procedure. The automated applications, which would be situated in a customer end-user environment, are more problematic as they involve having to deal with "VOC's" (volatile organic compounds), which may provide health as well as environmental hazards in these situations.

Whereas a wide range of lacquers may be employed for the final stage of the process, it has been found that water-soluble amino-plasts, together with suitable acid catalysts, give excellent results. Examples of such resins are Cymels 373 and 385 (partially methylated melamine resins), Cymels 1171, 1172 (glycoluril resins), Cymels 323, 328 and 327 (methylated high imino melamine resins), UFR 60 and Dynomin UM-15 (methylated urea resins). Preferably the catalyst is only liberated by heat so that the coating solution has optimum pot life. An example of such a catalyst is Cycat 4045 (amine blocked para toluene sulfonic acid). Resulting coatings may be glossy, or a filler can be added to produce a matt effect. Whilst the use of a water-based lacquer may not have been anticipated as working on a water-based ink jet ink because of the danger of bleeding, not only was it found to work in the type of substrate coatings described above, but it provides an optimal solution where the customer would be doing the lacquering and where solvents or UV can be avoided and a least harmful water system chosen instead. In addition to amino-plasts which are cross-linkable, water-based emulsions have also been found to be suitable. Examples of suitable emulsions are Flexobonds 325 and 381, Walpol 40-136, Synthamul 40412-03 (carboxylated acrylic) and Arolon 880. After evaporation of the water, they form water-proof films without the need to cross-link and such emulsions have extremely long pot-lives. Also, the temperature at which water can be evaporated from the coating is lower than that needed to cross-link amino-plasts.

In order to ensure that the final imaged material is sufficiently resistant for applications, a number of tests were conducted. Rub/abrasion tests were done using an ATTC Crockmeter model CM5 and following Test Method 8. Imaged material without an overcoat was tested with dry rubbing and after 4 rubs generally showed very poor rub resistance with the image being almost entirely removed in some areas and the Crock squares showing high color transfer. Material after coating was tested for up to 100 rubs both dry and wet and with water, alcohol, petroleum spirit and methyl ethyl ketone.

The following examples illustrate the processes as described. All formulations are given by weight.

EXAMPLE I

| | |
|---|---|
| 12% solution of polyvinyl alcohol in water. | 2 |
| 35% solution of polyacrylic acid in water | 5 |
| Water | 14.3 |
| BYK 346 | 0.3 |
| Walpol | 5.0 |
| Ethanol | 6.3 |
| Kronos 2065 | 5.6 |

This mixture was ball-milled for 2 hours to disperse the Titanium dioxide and then wire rod coated on clear 175-micron polyester. It was dried at 110° C. for 2 minutes to produce a film of 10 grams per square meter.

The sheet was imaged in an Epson Stylus C82 ink jet printer and then heated for 4 minutes at 140° C. The following mixture was made up:

| | |
|---|---|
| Water | 3 |
| Cymel 385 | 2.5 |
| Superwetting Agent Q2-5211 | 0.1 |
| Cycat 4040 | 0.1 |

This was coated to a thickness of 4.6 grams per square meter and dried/cured in an oven at 140° C. for 4 minutes.

EXAMPLE II

| | |
|---|---|
| Klucel E | 1.26 |
| Polyacrylic acid | 6.79 |
| BYK 346 | 1.88 |
| Setalux 17-1745 | 13.7 |
| Kronos 2065 | 15.96 |
| Ethanol | 55.28 |
| Ethyl Acetate | 5.13 |

This was ball milled for 2 hours and then coated and dried at 110° C. for 2 minutes onto white polyester to give a dry coating weight of 9.5 grams per square meter. This material was imaged in an Epson Stylus C82 ink jet printer and the sheet heated for 4 minutes at 140° C. to dry out the material. The sheet was then coated with Flexobond 325 with a layer that dried at 120° C. for 2 minutes to a dry weight of 7 grams per square meter.

EXAMPLE III

| | |
|---|---|
| Klucel E | 1.5 |
| Polyacrylic acid | 7.93 |
| BYK 346 | 2.27 |
| Setalux 17-1354 | 15.9 |
| Ethanol | 66.32 |
| Ethyl Acetate | 6.07 |

This was coated onto 175-micron transparent polyester and dried at 110° C. for 2 minutes to give a dry weight of 2.34 grams per square meter. The sheet was then imaged on an Epson Stylus C82 ink jet printer to give a laterally inverted image and then heated to 140° C. for 4 minutes to dry out the inks. This was then laminated onto a pressure sensitive coated white PVC (polyvinyl chloride). The image could be viewed through the polyester that provided a physical and chemical barrier to wear.

SOURCES OF RAW MATERIALS

Flexobond 325, Flexobond 381. Air Products and Chemicals, Allentown, Pa., USA.

Walpol 40-136, Synthamul 40412-03, Arolon 880. Reichold Inc., Research Triangle Park, N.C. USA.

Setalux 17-1354, Setalux 17-1745. Akzo Nobel, Maastricht, The Netherlands.

Cymel 373, 385, 1171, 1172, 323, 328, 327. UFR 60, Dynomin UM-15, Cycat 4045, Cycat 4040. Cytec Industries, Five Garret Mountain Plaza, West Patterson, N.J., USA.

BYK 346 BYK-Chemie GmbH, Postfach, 100245, Wesel, Germany.

Kronos 2065 Kronos Inc. Huston, Tex., USA

Klucel E—Hercules Inc. Wilmington. Del., USA.

Super Wetting Agent.Q2-5211. Dow Corporation. Midland, Mich., USA.

The invention claimed is:

1. A method of producing ink jet printed images with high resistance to physical and chemical damage on plastic surfaces, comprising the steps of:

a. providing a plastic object;

b. coating at least part of the surface of the plastic object with an under-coating solution that does not contain a reactive species;

c. evaporating off the volatile part of the under-coated solution, thus depositing a solid film on the surface of the plastic object;

d. providing at least one ink-jet ink comprising a colorant and aqueous carrier;

e. jetting the ink by means of an ink-jet system onto the surface of the under-coating on the plastic object;

f. warming the printed surface to drive part of the water in the ink into the under-coating and to evaporate the remaining part of the water;

g. over-coating the dried surface with a water-based coating; and h. heating the over-coating to dry or cure it and to seal-in the previously deposited ink and under-coating.

2. The method of claim 1, wherein the under-coating solution contains a mixture of hydrophilic polymer or polymers together with a hydrophobic polymer; and wherein none of the polymers in the undercoating react with other polymers in the undercoating.

3. The method of claim 1, wherein the ink-jet ink colorant is a dye or a pigment.

4. The method of claim 1, wherein the plastic object is a card or a bottle.

5. The method of claim 1 where the plastic object is composed of a polyester or polyvinyl chloride.

6. The method of claim 1, wherein said water-based coating for over-coating comprises water-soluble aminoplasts and acid catalysts.

7. The method of claim 1, wherein said water-based coating for over-coating comprises water-based emulsions or a water-based emulsion plus alkali.

8. The method of claim 1, performed as a single composite action, which is automated to the extent that at no stage involves human handling.

9. The method according to claim 8, wherein a plastic bottle is under-coated, imaged and over-coated.

10. The method according to claim 1, wherein no chemical reaction occurs.

11. The method according to claim 1, wherein the under-coating is dried in sheet form for subsequent imaging and over-coating.

12. The method according to claim 11, wherein a plastic card is under-coated, imaged and over-coated.

13. The method according to claim 1, wherein a plastic card is coated and imaged.

14. The method according to claim 1, wherein a plastic bottle is coated and imaged.

15. The method according to claim 14, wherein said ink-jet image comprises a color image, additionally comprising a white under-layer, said color image viewable without influence of any contents of said bottle.

16. An object imaged according to the method of claim 1, wherein the image surface is resistant to at least 100 strokes of the Crockmeter, dry or in contact with solvents, thus exhibiting high physical and chemical resistance.

* * * * *

UNITED STATES PATENT AND TRADEMARK OFFICE

CERTIFICATE OF CORRECTION

PATENT NO. : 7,370,956 B2
APPLICATION NO. : 10/552018
DATED : May 13, 2008
INVENTOR(S) : Murray Figov It is certified that error appears in the above-identified patent and that said Letters Patent is hereby corrected as shown below:

| | |
|---|---|
| Title Page, Col. 2, FOREIGN PATENT DOCUMENTS, Line 3 | Delete "WO 97/270053 A1" and insert --WO 97/27053 A1-- |

Signed and Sealed this

Thirtieth Day of June, 2009

JOHN DOLL
*Acting Director of the United States Patent and Trademark Office*